United States Patent [19]

Heinemeyer et al.

[11] Patent Number: 4,769,734

[45] Date of Patent: Sep. 6, 1988

[54] SAFETY CIRCUIT FOR ELECTRIC DETONATOR ELEMENT

[75] Inventors: Friedrich Heinemeyer, Siegburg; Winfried Nass, Troisdorf, both of Fed. Rep. of Germany

[73] Assignee: Dynamit Nobel Aktiengesellschaft, Troisdorf, Fed. Rep. of Germany

[21] Appl. No.: 771,019

[22] Filed: Aug. 30, 1985

[30] Foreign Application Priority Data

Aug. 30, 1984 [DE] Fed. Rep. of Germany ..... 3431818

[51] Int. Cl.[4] ..... H02H 9/04

[52] U.S. Cl. ..... 361/56; 361/91; 102/202.4

[58] Field of Search ..... 361/56, 86, 91, 88, 361/110, 111, 118, 119; 102/202.4, 202.5, 202.9, 202.1, 202.3

[56] References Cited

U.S. PATENT DOCUMENTS

| | | | |
|---|---|---|---|
| 3,793,535 | 2/1974 | Chowdhuri | 361/56 X |
| 3,934,175 | 1/1976 | Clark | 361/91 X |
| 3,986,560 | 10/1976 | Heath et al. | 340/592 X |
| 4,061,088 | 12/1977 | Ueda | 102/202.4 |
| 4,393,779 | 7/1983 | Brede et al. | 102/202.5 |
| 4,520,419 | 5/1985 | Locher et al. | 361/56 X |
| 4,563,720 | 1/1986 | Clark | 361/91 X |
| 4,584,622 | 4/1986 | Crosby et al. | 361/56 |
| 4,587,588 | 5/1986 | Goldstein | 361/91 X |

FOREIGN PATENT DOCUMENTS

| | | | |
|---|---|---|---|
| 630697 | 10/1978 | U.S.S.R. | 361/56 |

*Primary Examiner*—Philip H. Leung
*Assistant Examiner*—Derek S. Jennings
*Attorney, Agent, or Firm*—Antonelli, Terry & Wands

[57] ABSTRACT

A safety circuit for an electric detonator element connected to two electrical leads and having a subsequently arranged detonable charge. The safety circuit includes an electrical component connected in parallel to the detonator element between the two leads, the electrical component having an initial condition wherein the electrical component is at least substantially electrically non-conductive. The electrical component is responsive to a signal having a voltage value above a maximum ignition voltage value for enabling triggering of a detonator element for being converted from the initial condition thereof to a final condition wherein the electrical component provides a short circuit path in parallel to the detonator element so as to prevent improper initiation of the electrical detonator element.

11 Claims, 1 Drawing Sheet

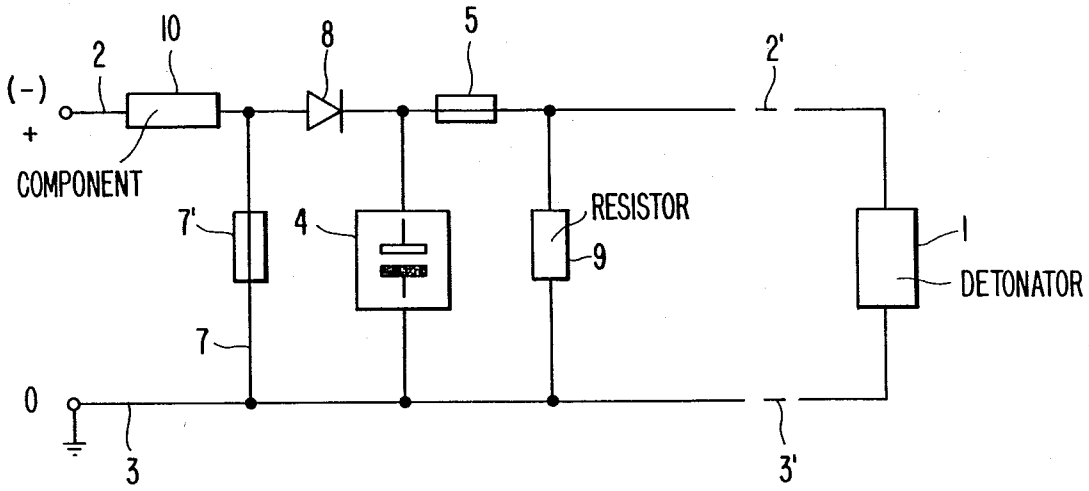
DETONATOR
1
2'
3'
RESISTOR
9
5
8
4
10
7'
7
2
3
(-)
+
COMPONENT
0

SAFETY CIRCUIT FOR ELECTRIC DETONATOR ELEMENT

The present invention relates to a safety or protection circuit for an electric detonator with subsequently arranged detonable charge and two leads.

Electric detonator elements, such as gap-type or bridge-type detonator elements, are the more sensitive to unintended ignitions, e.g., by stray currents of high-frequency interference, the smaller the ignition current required for triggering. In order to render these detonator elements safer with respect to accidental ignition, various measures have become conventional. Thus, for example, resistors or shorting-out plug connections are disposed in parallel to the detonator elements. Although a reduction of the current flowing via the detonator element is obtained on account of the current branching caused by the parallel-connected resistor, and thus, in turn, a certain increase in safety is achieved, the result is not as yet satisfactory. Shorting-out plug connections must be pulled out manually prior to the intentional triggering of the detonator element so that no protective effect exists for a more or less long period of time.

This possibility of unintentional ignition is critical, in particular, if unexpected trouble arises during the functional testing of the detonator element with the detonable charge connected therebehind, or also during usage of such detonator elements under practical conditions. In functional tests, performed in a spot-check fashion, the detonator elements with the subsequently arranged charge are exposed to extreme stresses bordering on the limit of stress-bearing capacity. These involve, in particular, vibration stresses, dropping tests, temperature fluctuation stresses, and moisture tests. Contacting difficulties can arise in the mechanical arrangement of the detonator element with subsequently connected charge due to such extreme loads during functional testing, or also during pratical usage.

Therefore, it is an object of the present invention to further increase the safety of electric detonator elements with subsequently arranged detonable charges, such as detonator, transmission charge, and actual explosive charge.

This object has been attained according to this invention by a safety circuit including an electrical component connected in parallel to the detonator element between two leads with the electrical component, in its initial condition, being at least substantially electrically nonconductive, but being convertible, by a current having a voltage above the maximum ignition voltage provided for the triggering of the detonator element into a final condition wherein the electrical component forms a short circuit in parallel to the detonator element.

It is, thus, possible advantageously to reestablish handling safety in detonator elements of the aforementioned type wherein the intentional triggering has not been successful due to interruptions in the electrical system, in that a defined short-circuit connection is set up in parallel to the detonator element. Such interruptions are critical for the reason that they can be unstable so that, after they have again disappeared, an unintentional triggering, for example, by stray currents, would be possible. The actual existence of the short-circuit connection can be checked by measurement of the ignition circuit.

Semiconductor resistors can be utilized, for example, for the establishment of this short-circuit connection, which resistors can be destroyed by means of a current having a corresponding voltage so that a short circuit arises. However, according to a feature of the present invention, the use of sintered tantalum capacitors is especially advantageous, wherein controlled electric breakdowns always result in a short circuit, but wherein the energy for producing this short-circuit connection is not so large that the entire component is thereby destroyed.

In order to take the possibility into consideration that, due to aforementioned stresses, also unstable circuits can occur, for example, in the contacting, in the leads, or in the detonator element proper, an additional fuse can be arranged, according to another feature of the present invention, in one lead, which fuse can be burnt through by means of a current larger than the maximum ignition current for 100% ignition. Here again, it is also possible to check, prior to handling the detonator element, by measurement or the like of the ignition circuit to determine whether the fuse has indeed burnt through and, thus, the lead has been interrupted.

For especially high safety requirement, both of the above-described measures can also be combined with each other in such a way that, as seen from the supply side of the ignition energy, the component producing the short-circuit connection is arranged in front of the additional fuse. It is then possible by means of this circuit first to burn through the fuse and then to produce a defined short circuit.

According to another feature of the present invention, a still further fuse element can be provided, finally, in order to take the further possibility into account that even with a proper condition of the ignition circuit, triggering is possible by stray currents or high-frequency interference. This fuse element is a short-circuit bridge preferably designed as a wire soldered in place between the two leads which can be destroyed in a controlled fashion by means of a current of corresponding magnitude and polarity with the aid of a subsequently arranged, blocking semiconductor element, preferably a blocking diode, without triggering the detonator element. However, in place of the wire bridge, it is also possible to provide, for example, a thin conductor path which is burnt up, or a low-ohmic resistor which is interrupted.

This further short-circuit element represents an additional preliminary arming measure which is overcome only directly prior to the intentional triggering by means of a corresponding electric current. Beforehand, the ignition lines can be measured separately via this short-circuit element with respect to the maintenance of the required resistance data. After this preliminary arming has been eliminated, the entire ignition circuit can once again be measured in order to be able to determine its flawless condition or a possible interruption and/or short circuit.

The safety circuit of this invention is preferably made directly an integral part of the detonator element arrangement, but it can also be disposed in close proximity to the latter.

These and further objects, features and advantages of the present invention will become more obvious from the following description when taken in connection with the accompanying single figure of drawing which shows one embodiment of a safety circuit in accordance with the present invention.

A detonator element 1, with a subsequently arranged, detonable charge, not shown, can be connected via leads 2 and 3 to an electric current source, not illustrated. The leads are shown to be interrupted at 2' and 3' to indicate that the safety circuit described in more detail below can also be disposed at a spacing from the detonator element 1. A component 4, preferably a sintered tantalum capacitor, which provides a controlled short circuit, is located between the two leads 2 and 3. Furthermore, a fuse 5 is arranged in the lead 2, providing, in case of short circuit, a controlled interruption of the lead 2. Finally, a short-circuit bridge 7 with a low-ohmic fuse 7', here indicated symbolically, is provided in parallel to the detonator element 1. The bridge 7 is preferably a wire bridge directly soldered in between the two leads 2 and 3. As seen from the supply side of the ignition energy behind the short-circuit bridge 7, a blocking diode 8 is furthermore disposed, finally, in the lead 2; this blocking diode being constructed such that it blocks against negative current.

Conventionally, a resistor 9 can then also be additionally included, connected in parallel to the detonator element 1 for the purpose of obtaining current branching. For additional protection against strong stray currents or high-frequency interference, a component 10 can furthermore also be arranged conventionally in the lead 2. The component 10 may be a resistor or a choke coil. Such strong interference voltages can occur, for example, when blasting in the proximity of transformer stations, radar installations, high-voltage lines, or the lightning-endangered areas, where extremely high stray-current safety is needed. The short-curcuit bridge 7 turns a sensitive detonator element into a highly insensitive one.

The mode of operation of the safety circuit is as follows: The short-circuit bridge 7 is destroyed in a controlled fashion by a negative voltage applied to the lead 2, optionally after first measuring the ignition lines so as to enable arming of the detonation element 1. During this step, the blocking diode 8 prevents any effect on the detonation element 1. After elimination of the short-circuit bridge 7, the entire ignition circuit can then optionally be measured. If this should yield the result that the resistance is infinitely high, or at the last substantially too high, then, by means of a current of corresponding magnitude, a short circuit can be established purposely as steady state by way of the component 4, in parallel to the detonator element 1 so as to prevent triggering of the detonator 1. If, in contrast to the above, measuring of the ignition circuits shows a short circuit or a condition similar to a short circuit, then the lead 2 can be interrupted in a controlled fashion by interruption of the fuse 5 by means of a positive voltage applied to the lead 2, so that here again handling safety is ensured. Optionally, also an additional, defined short circuit can be established via the member 4 by means of a positive voltage applied to the lead 2, in order to still further increase the safety factor.

Once no faulty conditions of the ignition circuit have been determined, i.e., with the bridge 7 being removed, the component 4 in its initial electrically non-conductive condition and with the fuse 5 not being burnt through, by the application of a positive voltage of corresponding size to the lead 2, the intentional triggering of the detonation element 1 is effected.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. A safety circuit adapted to be connected to an electronic detonator element connected to two electrical leads and having a subsequently arranged detonable charge, the safety circuit comprising electrical component means for preventing unintended intiation of the electric detonator element and connected in parallel to the electric detonator element between the two electrical leads, the electric component means having an inital condition wherein the electrical component means is at least substantially electrically non-conductive, the electrical component means being responsive to a current having a voltage value above a maximum ignition voltage value for enabling triggering of the elecrtric detonator element for being converted from the initial condition thereof to a final condition wherein the electrical component means provides a short circuit path in parallel to the electric detonator element so as to prevent unintended initiation of the electric detonator element, and wherein the electrical component means includes a sintered tantalum capacitor connected in parallel with the electric detonator element.

2. A safety circuit according to claim 1, further comprising a fuse arranged in one of the two electrical leads, the fuse being responsive to a signal having an amperage value higher than a maximum amperage value for enabling triggering of the detonator element for being destroyed so as to provide an interrupted circuit path in the one electrical lead.

3. A safety circuit according to claim 1, further comprising a semiconductor element arranged in one of the two electrical leads for blocking current flow in one direction and means for providing a short-circuit bridge connecting the two electrical leads, the short-circuit bridge means being arranged in front of the semiconductor element in the direction of the supply of an ignition signal to the electric detonator element, the short-circuit bridge means being responsive to a current for which the semiconductor element exerts a blocking action for being destroyed without enabling triggering of the detonator element.

4. A safety circuit according to claim 3, wherein the short-circuit bridge means is connected in parallel with the electric detonator element and the electrical component means, the semiconductor element being arranged in the one electrical lead between the connection points of the short-circuit bridge means and the electrical component means to the one electrical lead, the semiconductor element blocking a negative current.

5. A safety circuit according to claim 1, wherein the electrical component means is responsive to a current having a voltage value above a maximum ignition voltage value for enabling triggering of the electric detonator element for being substantially instantaneously converted from the initial condition wherein the electrical component means is at least substantially electrically non-conductive, to the final condition wherein the electrical component means provides a short circuit path in parallel with the electrical detonator element.

6. A safety circuit adapted to be connected to an electronic detonator element connected to two electrical leads and having a subsequently arranged detonable charge, the safety circuit comprising electrical component means for preventing unintended initiation of the electric detonator element and connected in parallel to the electric detonator element between the two electrical leads, the electric component means having an initial condition wherein the electrical component means is at least substantially electrically non-conductive, the electrical component means being responsive to a current having a voltage value above a maximum ignition voltage value for enabling triggering of the electric detonator element for being converted from the initial condition thereof to a final condition wherein the electrical component means provides a short circuit path in parallel to the electric detonator element so as to prevent unintended initiation of the electric detonator element, and further comprising a fuse arranged in one of the two electrical leads, the fuse being responsive to a signal having an amperage value higher than a maximum amperage value for enabling triggering of the electric detonator element for being destroyed so as to provide an interrupted circuit path in the one electrical lead.

7. A safety circuit according to claim 6, further comprising a semiconductor element arranged in one of the two electrical leads for blocking current flow in one direction and means for providing a short-circuit bridge connecting the two electrical leads, the short-circuit bridge means being arranged in front of the semiconductor element in the direction of the supply of an ignition signal to the electric detonator element, the short circuit bridge means being responsive to a current for which the semiconductor element exerts a blocking action for being destroyed without enabling triggering of the electric detonator element.

8. A safety circuit according to claim 7, wherein the short-circuit bridge means is connected in parallel with the electric detonator element and the electrical component means, the semiconductor element being arranged in the one electrical lead between the connection points of the short circuit bridge means and the electrical component means to the one electrical lead, the semiconductor element blocking a negative current.

9. A safety circuit according to claim 6, wherein the electrical component means is a sintered tantalum capacitor connected in parallel with the electric detonator element.

10. A safety circuit adapted to be connected to an electronic detonator element connected to two electrical leads and having a subsequently arranged detonable charge, the safety circuit comprising electrical component means for preventing unintended initiation of the electric detonator element and connected in parallel to the electric detonator element between the two electrical leads, the electric component means having an initial condition wherein the electrical component means is at least substantially electrically non-conductive, the electrical component means being responsive to a current having a voltage value above a maximum ignition voltage value for enabling triggering of the electric detonator element for being converted from the initial condition thereof to a final condition wherein the electrical component means provides a short circuit path in parallel to the electric detonator element so as to prevent unintended initiation of the electric detonator element, and further comprising a semiconductor element arranged in one of the two electrical leads for blocking current flow in one direction and means for providing a short-circuit bridge connecting the two electrical leads, the short-circuit bridge means being arranged in front of the semiconductor element in the direction of the supply of an ignition signal to to the electric detonator element, the short-circuit bridge means being responsive to a current for which the semiconductor element exerts a blocking action for being destroyed without enabling triggering of the electric detonator element.

11. A safety circuit according to claim 10, wherein the short-circuit bridge means is connected in parallel with the electric detonator element and the electrical component means, the semiconductor element being arranged in the one electrical lead between the connection points of the short-circuit bridge means and the electrical component means to the one electrical lead, the semiconductor element blocking a negative current.

* * * * *